United States Patent [19]

Beneke et al.

[11] Patent Number: 4,871,443

[45] Date of Patent: Oct. 3, 1989

[54] NOVEL METHOD FOR EXTRACTION OF SALTS FROM COAL TAR AND PITCHES

[75] Inventors: Herbert Beneke, Castrop-Rauxel; Arnold Alscher, Essen; Rudolf Oberkobusch, Duisburg; Siegfried Peter, Uttenreuth-Weiher; Wolfgang Jaumann, Nuremberg, all of Fed. Rep. of Germany

[73] Assignee: Rutgerswerke AG, Fed. Rep. of Germany

[21] Appl. No.: 331,592

[22] Filed: Mar. 30, 1989

Related U.S. Application Data

[63] Continuation of Ser. No. 100,470, Sep. 24, 1987, abandoned.

[30] Foreign Application Priority Data

Oct. 28, 1986 [DE] Fed. Rep. of Germany ..... 3636560

[51] Int. Cl.[4] ..... C10C 3/02; C10C 3/08

[52] U.S. Cl. ..... 208/39; 208/45; 208/433

[58] Field of Search ..... 208/45, 433, 39

[56] References Cited

U.S. PATENT DOCUMENTS

| | | | |
|---|---|---|---|
| Re. 32,120 | 4/1986 | Low | 208/433 |
| 2,572,583 | 10/1951 | Antle | 208/45 |
| 3,202,605 | 8/1965 | Redcay | 208/45 |
| 4,036,731 | 7/1977 | Martin | 208/433 |
| 4,101,416 | 7/1978 | Dolbear | 208/433 |
| 4,127,472 | 11/1978 | Migitaku et al. | 208/45 |
| 4,208,267 | 6/1980 | Diefendorf | 208/45 |
| 4,219,404 | 8/1980 | Dickakian | 208/22 |
| 4,259,171 | 3/1981 | Stedelhofel | 208/45 |
| 4,402,824 | 9/1983 | Sunami et al. | 208/45 |
| 4,482,453 | 11/1984 | Coombs et al. | 208/45 |
| 4,502,943 | 3/1985 | Dickakian et al. | 208/45 |
| 4,503,026 | 3/1985 | Dickakian et al. | 423/447.4 |
| 4,517,672 | 5/1985 | Cukier et al. | 208/45 |
| 4,559,133 | 12/1985 | Siegfried et al. | 208/424 |
| 4,575,412 | 3/1986 | Yudate et al. | 208/45 |
| 4,578,177 | 3/1986 | Yudate et al. | 208/45 |
| 4,582,591 | 4/1986 | Hoerneyu et al. | 208/45 |
| 4,604,184 | 8/1986 | Cukier et al. | 208/45 |
| 4,637,906 | 1/1987 | Fukuda et al. | 208/45 |
| 4,640,761 | 2/1987 | Mori et al. | 208/45 |

*Primary Examiner*—Asok Pal

*Attorney, Agent, or Firm*—Bierman and Muserlian

[57] ABSTRACT

A method of removing salts from coal tar and coal pitches comprising washing coal tar or coal pitch in a pressure container with water and a carbon dioxide containing gas at a temperature and pressure near the critical point of the gas in the optional presence of at least one member of the group consisting of a solvent and an entraining agent, removing the liquid or dissolved tar or pitch to obtain tar or pitch with a low salt content and removing the aqueous phase whereby all the resins remain in the tar or pitch.

9 Claims, No Drawings

NOVEL METHOD FOR EXTRACTION OF SALTS FROM COAL TAR AND PITCHES

PRIOR APPLICATION

This application is a continuation of U.S. patent application Ser. No. 100,470 filed Sept. 24, 1987, now abandoned.

STATE OF THE ART

Ammonium chloride present in crude tar causes severe corrosion damage in distillation columns used during tar processing. Since the salt is water-soluble, the water present in the crude tar is mechanically separated but approximately up to 2% water (Franck/Collin: Coaltar, p. 27) is still retained in the tar. In an additional washing process with water, the content of ammonium chloride can be further decreased but this measure is too involved and expensive if the chloride content is to be decreased to the point where no further chloride corrosion takes place. Therefore, the chloride usually is bound to a stronger base to avoid the ammonium chloride changing into the gaseous phase. This generally takes place by adding a measured amount of an aqueous NaOH or $Na_2CO_3$ solution depending on the chloride content of the tar. The formed salts like all other ash-forming substances remain in the particular distillation residue during tar processing, thus in the normal pitch, hard pitch or pitch coke.

Especially when using the pitch as a binding agent for the coke as carbon material in the manufacture of anodes for the aluminum electrolysis, metallic impurties are extremely undesirable. Not only do they form additional slag, but they also increase the consumption of the the anode. This is especially true of sodium which acts as an oxidation catalyst (Light Metals, AIME 1981, 471–476).

For the removal of insoluble ash-forming substances, innumerable methods exist like filtering, centrifuging, and promoting agent to accelerate settling, possibly also by adding supercritical solvents. All these methods have in common that they do not act selectively but separate non-soluble or specific heavier particles, like soot-like coaltar resins for example, which are insoluble is quinoline. These so-called $\alpha$-resins are important components of the coaltar pitch for the desired applications since they increase the coke yield and advantageously affect the stability of the anodes.

OBJECTS OF THE INVENTION

It is a object of the invention to provide a selective method of removing salts from coal tar and coal pitch without removing the desired resins.

This and other objects and advantages of the invention will become obvious from the following detailed description.

THE INVENTION

The novel method of the invention for removing salts from coal tars and coal pitches comprises washing coal tar or coal pitch in a pressure container with water and a carbon dioxide containing gas at a temperature and pressure near the critical point of the gas in the optional presence of at least one member of the group consisting of a solvent and an entraining agent, removing the liquid or dissolved tar or pitch to obtain tar or pitch with a low salt content and removing the aqueous phase.

The aqueous phase and the coal tar or coal pitch phase can be separated in any suitable manner such as by decanting off the phases separately and then reducing the pressure to normal. The entraining agent and a solvent are removed in this latter stage. If the washing is carried out only once, substantially all the chlorides, i.e., sodium chloride and ammonium chloride are removed and more than 50% of any zinc salts i.e., zinc sulfides, are also removed while all the resins remain in the tar or pitch. Removal of the salts is increased if the washing is a multistage process.

By adding solvents, the temperature of the washing process and the viscosity, particularly of high-melting pitches, can be lowered. With normal tars and pitches, this is not required since the supercritical carbon dioxide is easily dissolved not only in water but also in the tar or pitch, respectively. Additional entraining agents also offer the possibility to influence the density of the phases.

Surprisingly, it was found that the zinc present in the tar in the form of insoluble zinc sulfide dissolves to a large extent in the aqueous phase, precipitates from the aqueous phase after expansion and can be filtered out. In this way, it becomes possible to recycle the water and increase the content of sodium and ammonium chloride, respectively, to the extent to which it is technically advantageous. Subsequently, the water must be at least partially treated or renewed.

During the washing process, the system of pitch or tar, water and $CO_2$ containing-gas are present preferably in the supercritical state. If additional entraining agents or solvents are used, they can be separated in stepwise expansions from the pitch and re-used. As solvents, all known pitch solvents are considered such as pure aromatic compounds like toluol or aromatic oils, for example washing oils, or also tar bases like pyridine and quinoline which to some extent can also be used as entraining agents. Carbon dioxide-containing gases are, besides pure carbon dioxide, also mixtures of hydrocarbons of 1 to 6 carbon atoms like propane, butane or liquid petroleum gas.

In the following examples there are described several preferred embodiments to illustrate the invention. However, it should be understood that the invention is not intended to be limited to the specific embodiments.

EXAMPLE 1

400 g of coal pitch having a softening point of 70° C. and an ash content of 2600 parts per million and 500 g of water were placed into a stirring autoclave which was closed and heated to 150° C. During pressurization with $CO_2$ gas, mixing of the two phases began and after 3 hours during which time the $CO_2$ pressure is kept at 100 bar, reaction occured. The phases were separated and drawn off. Test samples of the pitch sample and the washed pitch were incinerated according to DIN 51719 and the amounts of ZnO and NaCl were determined. The results are reported in Table I.

TABLE 1

| | Total ash | ZnO | NaCl |
|---|---|---|---|
| starting pitch sample | 2600 ppm* | 1095 ppm | 455 ppm |
| washed pitch | 1100 ppm | 137 ppm | 26 ppm |
| % decrease | 57.7% | 87.5% | 94.3% |

*parts per million

EXAMPLE 2

400 g of coaltar with a zinc content of 653 ppm and a chloride content of 1652 ppm (according to DIN 51577) were placed with 400 g of water into an autoclave which was then heated to 80° C. and pressurized to 100 bar with $CO_2$. The reactants were strongly stirred for 4 hours and then the two phases were separated by settling. The ash and zinc contents and the chlorine in the tar were determined and the results are summarized in Table II.

TABLE II

| | Total ash | ZnO | Cl |
|---|---|---|---|
| starting pitch sample | 3100 ppm | 813 ppm | 1652 ppm |
| washed tar | 900 ppm | 336 ppm | 42 ppm |
| % decrease | 71% | 59% | 97.5% |

As can be seen from the analyses, the chlorine or the chlorides are almost completely removed in a single-stage washing. The content of zinc and the other ash-forming substances can be further reduced by several washing steps. In this connection, it is advantageous if the water is used with a countercurrent flow and the resulting insoluble salts are filtered during expansion. The advantage of the selective procedure lies in the fact that the fraction of the resins in the tars and pitches remains unchanged.

Various modifications of the method of the invention may be made without departing from the spirit or scope thereof and it is to be understood that the invention is intended to be limited only as defined in the appended claims.

What we claim is:

1. A method of selectively removing salts from coal tars and coal pitches without reducing the α-resin content comprising washing coal tar or coal pitch in a pressure container with water and a carbon dioxide containing gas at a temperature and pressure near the critical point of the carbon dioxide gas, removing the liquid or dissolved tar or pitch to obtain tar or pitch with a low salt content and removing the aqueous phase.

2. The method of claim 1 wherein the gas is carbon dioxide.

3. The method of claim 1 wherein the gas is a mixture of carbon dioxide and hydrocarbons of 1 to 6 carbon atoms.

4. The method of claim 1 wherein the carbon dioxide containing gas is present in the supercritical state during the washing.

5. The method of claim 1 wherein the removed aqueous phase is filtered and recycled to the washing step.

6. The method of claim 1 wherein said washing is carried out in the presence of at least one member of the group consisting of a solvent and an entraining agent.

7. The method of claim 6 wherein the solvent and entraining agent are present and are recovered with the tar or pitch phase and are removed by reduction of the pressure.

8. The method of claim 7 wherein the process is effected in several stages.

9. A coal tar or coal pitch produced by the process of claim 1.

* * * * *